US010261438B2

(12) United States Patent
Tauchi

(10) Patent No.: US 10,261,438 B2
(45) Date of Patent: Apr. 16, 2019

(54) TONER-RECEIVING AND TONER-SUPPLY/DEVELOPING ROLLER SYSTEMS FOR CONTROLLING TONER ACCUMULATION AND DROP DURING TONER RECOVERY

(71) Applicant: Kyocera Document Solutions Inc., Osaka (JP)

(72) Inventor: Yasuhiro Tauchi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/703,949

(22) Filed: Sep. 13, 2017

(65) Prior Publication Data

US 2018/0074435 A1 Mar. 15, 2018

(30) Foreign Application Priority Data

Sep. 13, 2016 (JP) ..... 2016-178265

(51) Int. Cl.
*G03G 15/08* (2006.01)
*G03G 15/01* (2006.01)

(52) U.S. Cl.
CPC ..... *G03G 15/0812* (2013.01); *G03G 15/0121* (2013.01); *G03G 15/0808* (2013.01); *G03G 15/0889* (2013.01); *G03G 2215/0634* (2013.01)

(58) Field of Classification Search
CPC ..... G03G 15/0812
USPC ..... 399/222
See application file for complete search history.

(56) References Cited

U.S. PATENT DOCUMENTS 8,699,925 B2 * 4/2014 Kashimoto ..... G03G 15/0812 399/272
9,046,812 B2 * 6/2015 Yamane ..... G03G 15/0806
2011/0229184 A1 * 9/2011 Kashimoto ..... G03G 15/0896 399/92
2012/0201575 A1 * 8/2012 Kashimoto ..... G03G 15/0812 399/272
2013/0209142 A1 * 8/2013 Kusukawa ..... G03G 15/081 399/274

FOREIGN PATENT DOCUMENTS

JP 2012-208469 A 10/2012

* cited by examiner

*Primary Examiner* — Quana Grainger
(74) *Attorney, Agent, or Firm* — HEA Law PLLC

(57) ABSTRACT

A developing device includes a developing roller, a toner supply roller, a regulating blade, a casing, a toner-reception supporting member, a toner reception member, and a vibration generating unit. The toner-reception supporting member is opposed to the developing roller or the toner supply roller between the regulating blade and the image carrier. The toner reception member is located so as to make a downward slope toward the toner supply roller side from the image carrier side along a longitudinal direction of the toner-reception supporting member. The toner reception member has a toner receiving surface that receives the toner dropping from the developing roller. The vibration generating unit vibrates the toner reception member. The toner reception member includes a sheet-shaped toner crushing member attached to overlap approximately a whole region of the toner receiving surface in a longitudinal direction. The toner crushing member is swingably supported with respect to the toner receiving surface.

8 Claims, 11 Drawing Sheets

TONER-RECEIVING AND TONER-SUPPLY/DEVELOPING ROLLER SYSTEMS FOR CONTROLLING TONER ACCUMULATION AND DROP DURING TONER RECOVERY

INCORPORATION BY REFERENCE

This application is based upon, and claims the benefit of priority from, corresponding Japanese Patent Application No. 2016-178265 filed in the Japan Patent Office on Sep. 13, 2016, the entire contents of which are incorporated herein by reference.

BACKGROUND

Unless otherwise indicated herein, the description in this section is not prior art to the claims in this application and is not admitted to be prior art by inclusion in this section.

A typical electrophotographic-method image forming apparatus irradiates a circumference surface of an image carrier (a photoreceptor drum) with a light based on image information read from a document image, or image information that is, for example, transmitted from an external device, such as a computer, to form a electrostatic latent image. After a toner is supplied to this electrostatic latent image from a developing device to form a toner image, this toner image is transferred on a paper sheet. The paper sheet after the transfer process is discharged to outside after a fixing process of the toner image is performed.

Recently, in association with progress of achieving color printing and high-speed processing, an image forming apparatus has become to have a complicated device configuration, while a toner stirring member needs to rotate at high speed in a developing device to meet the high-speed processing. Especially, in a development method that uses: a magnetic roller (toner supply roller) that uses a two-component developer including a magnetic carrier and a toner to carry the developer; and a developing roller that carries only the toner, a magnetic brush formed on the magnetic roller carries only the toner on the developing roller and, further, removes the toner, which has not been used for a development, from the developing roller in an opposing portion of the developing roller and the magnetic roller. Thus, in the proximity of the opposing portion of the developing roller and the magnetic roller, toner scattering easily occurs, and then the toner floated in a developing device is accumulated at the periphery of a trimming blade (regulating blade). When the accumulated toner condenses and attaches on the developing roller, a toner dropping occurs, and this may cause an image failure.

Here, for example, in a developing device that uses: a magnetic roller that uses a two-component developer including a magnetic carrier and a toner to carry the developer; and a developing roller that carries only the toner, there is proposed a developing device that includes a toner reception supporting member, a toner reception member, and vibration generating means. The toner reception supporting member is opposed to the developing roller or the magnetic roller. The toner reception member is located along a longitudinal direction of the toner reception supporting member and receives a toner that is dropped from the developing roller. The vibration generating means vibrates the toner reception member.

SUMMARY

A developing device according to one aspect of the disclosure supplies a toner to an image carrier on which an electrostatic latent image is formed. The developing device includes a developing roller, a toner supply roller, a regulating blade, a casing, a toner-reception supporting member, a toner reception member, and a vibration generating unit. The developing roller is located opposed to an image carrier on which an electrostatic latent image is formed. The developing roller supplies the toner to the image carrier in a region opposed to the image carrier. The toner supply roller is located opposed to the developing roller. The toner supply roller supplies the toner to the developing roller in a region opposed to the developing roller. The regulating blade is located opposed to the toner supply roller at a predetermined interval. The casing houses the developing roller, the toner supply roller, and the regulating blade. The toner-reception supporting member is located in the casing. The toner-reception supporting member is opposed to the developing roller or the toner supply roller between the regulating blade and the image carrier. The toner reception member is located so as to make a downward slope toward the toner supply roller side from the image carrier side along a longitudinal direction of the toner-reception supporting member. The toner reception member has a toner receiving surface that receives the toner dropping from the developing roller. The vibration generating unit vibrates the toner reception member. The toner reception member includes a sheet-shaped toner crushing member attached to overlap approximately a whole region of the toner receiving surface in a longitudinal direction. The toner crushing member is swingably supported with respect to the toner receiving surface.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
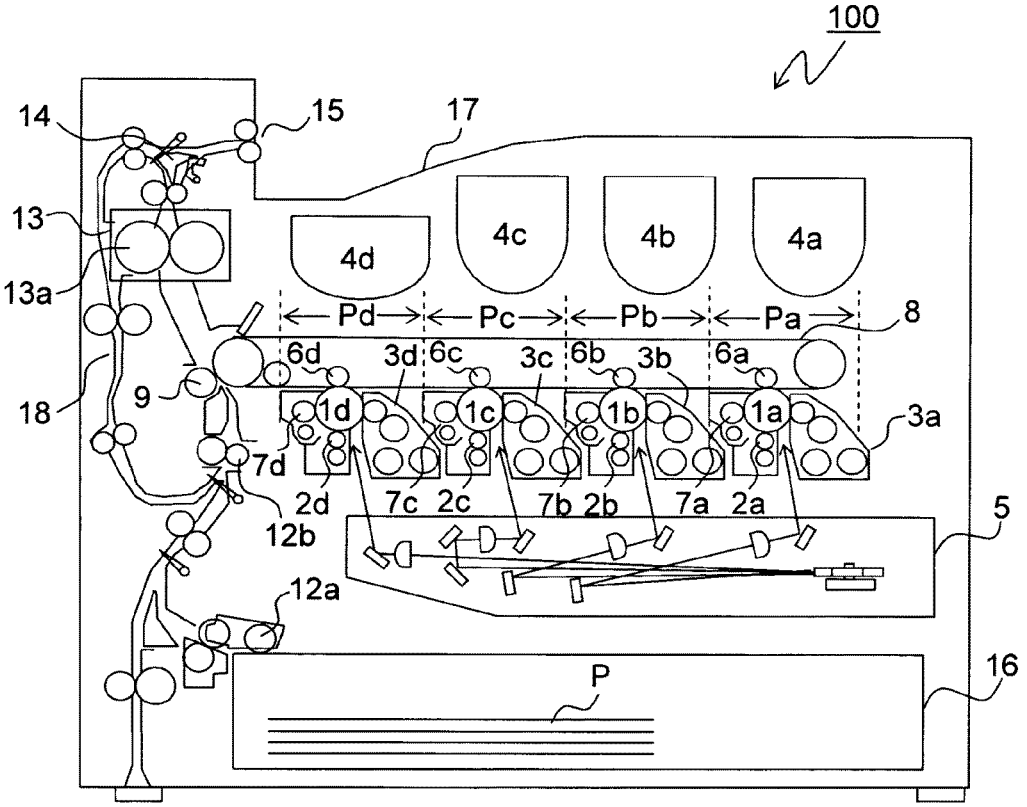
FIG. 1 illustrates a schematic configuration of a color printer including a developing device of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes embodiments of the disclosure with reference to the drawings. FIG. 1 illustrates a schematic cross-sectional view illustrating an image forming apparatus (which is also referred to as color printer) 100 including developing devices 3*a* to 3*d* of the disclosure and illustrates a tandem type color printer here. The color printer 100 includes four image forming units Pa, Pb, Pc, and Pd in this order from an upstream side in a conveyance direction (a right side in FIG. 1) in its main body. These image forming units Pa to Pd are located corresponding to images of four different colors (cyan, magenta, yellow, and black), and sequentially form the images of cyan, magenta, yellow, and black through respective processes of charging, exposure, development, and transfer.

These image forming units Pa to Pd include photoreceptor drums 1*a*, 1*b*, 1*c*, and 1*d*, which carry visible images (toner images) of respective colors, respectively. Additionally, an intermediate transfer belt 8, which rotates in a clockwise direction in FIG. 1, is located adjacent to the respective image forming units Pa to Pd.

When image data is input from a host apparatus such as a personal computer, first, chargers 2*a* to 2*d* evenly charge the surfaces of the photoreceptor drums 1*a* to 1*d*, and then an exposure apparatus 5 irradiates the photoreceptor drums 1*a* to 1*d* with light in accordance with the image data to form electrostatic latent images corresponding to the image data on the photoreceptor drums 1*a* to 1*d*. Toner containers 4*a* to 4*d* fill the developing devices 3*a* to 3*d* with predetermined amounts of two-component developers (hereinafter also simply referred to as a developer) including toners of respective colors of cyan, magenta, yellow, and black. The toners in the developers are supplied and electrostatically attached onto the photoreceptor drums 1*a* to 1*d* by the developing devices 3*a* to 3*d*. This forms the toner images corresponding to the electrostatic latent images formed by the exposure by the exposure apparatus 5.

Then, primary transfer rollers 6*a* to 6*d* apply electric fields at predetermined transfer voltages between the primary transfer rollers 6*a* to 6*d* and the photoreceptor drums 1*a* to 1*d*, and the toner images of cyan, magenta, yellow, and black on the photoreceptor drums 1*a* to 1*d* are primarily transferred on the intermediate transfer belt 8. Cleaning apparatuses 7*a* to 7*d* remove a remnant toner or similar matter on a surface of the photoreceptor drums 1*a* to 1*d* after the primary transfer.

Transferred papers P, on which toner images are to be transferred, are housed in a paper sheet cassette 16 located in a lower portion in the image forming apparatus 100. The transferred papers P are conveyed to a nip portion (secondary transfer nip portion), which is formed between a secondary transfer roller 9 located adjacent to the intermediate transfer belt 8 and the intermediate transfer belt 8, via a feed roller 12*a* and a registration roller pair 12*b* at a predetermined timing. The transferred paper P on which the toner images have been secondarily transferred is conveyed to a fixing unit 13.

The transferred paper P conveyed to the fixing unit 13 is heated and pressured by a fixing roller pair 13*a*. Then the toner image is fixed on a surface of the transferred paper sheet P, thus forming a predetermined full-color image. The transferred paper P, on which the full-color image is formed, is directly (or, after a branching portion 14 sends the transferred paper P into an inverting conveyance path 18 and images are formed on both surfaces) discharged to a discharge tray 17 by a discharge roller pair 15.

Figure 2:
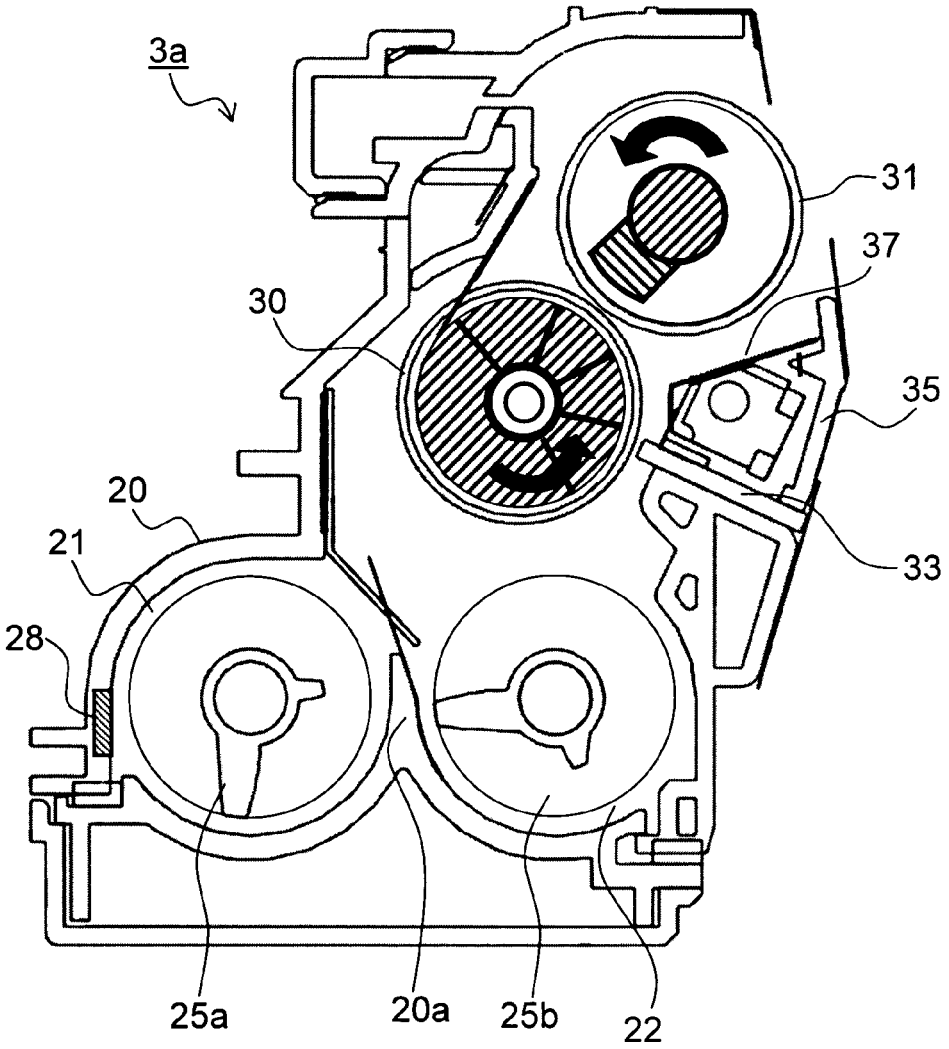
FIG. 2 illustrates a cross-sectional side view illustrating a developing device, which is included in a color printer, according to a first embodiment of the disclosure.

FIG. 2 illustrates a cross-sectional side view illustrating the developing device 3*a*, which is mounted in the color printer 100, according to a first embodiment of the disclosure. FIG. 2 illustrates a state viewed from a back side in FIG. 1, and locations of respective members, which are in the developing device 3*a*, are reversed with respect to a right and a left in FIG. 1. While the following describes the developing device 3*a* located in the image forming unit Pa of FIG. 1 as an example, configurations of the developing device 3*b* to 3*d* located in the image forming units Pb to Pd are basically identical, and thus their description will be omitted.

As illustrated in FIG. 2, the developing device 3*a* includes a developing container (casing) 20 that houses the two-component developer, which includes a toner and a magnetic carrier, (hereinafter also simply referred to as a developer). The developing container 20 is partitioned into a stir conveyance chamber 21 and a supply conveyance chamber 22 by a partition wall 20*a*. In the stir conveyance chamber 21 and the supply conveyance chamber 22, a stir conveyance screw 25*a* and a supply conveyance screw 25*b* are each rotatably arranged. The stir conveyance screw 25*a* and the supply conveyance screw 25*b* mix the toner (a positively charged toner) supplied from the toner container 4*a* (see FIG. 1) with a carrier, and stir and charge the toner.

Then, the developer is conveyed in an axial direction (a direction orthogonal to a paper surface of FIG. 2) while being stirred by the stir conveyance screw 25*a* and the supply conveyance screw 25*b*. The developer is circulated between the stir conveyance chamber 21 and the supply conveyance chamber 22 via a developer passing path (not illustrated) that are formed on both end portions of the partition wall 20*a*. That is, the stir conveyance chamber 21, the supply conveyance chamber 22, and the developer passing path form a circulation route of the developer in the developing container 20.

The developing container 20 obliquely extends toward an upper right in FIG. 2. A toner supply roller 30 (developer carrier) is located above the supply conveyance screw 25*b* in the developing container 20. A developing roller 31 is obliquely located above an upper right of the toner supply roller 30 and opposed to the toner supply roller 30. Then, the developing roller 31 is opposed to the photoreceptor drum 1*a* (see FIG. 1) at an opening side (a right side in FIG. 2) of the developing container 20, and the toner supply roller 30 and the developing roller 31 rotate about respective rotation axes in an anticlockwise direction in FIG. 2.

The stir conveyance chamber 21 includes a toner density sensor 28 opposed to the stir conveyance screw 25*a*. The toner density sensor 28 detects a proportion (T/C) of the toner to the carrier in the developer, and, for example, a magnetic permeability sensor that detects magnetic permeability of the developer in the developing container 20 is employed. The embodiment is configured such that the toner print density sensor 28 detects a magnetic permeability of the developer and outputs a voltage value that corresponds to the detection result to a control unit (not illustrated), which will be described later. The control unit determines the toner print density from an output value of the toner print density sensor 28. The control unit transmits a control signal to a toner-replenishment motor (not illustrated) in accordance with the determined toner print density, and then a predetermined amount of a toner is replenished to the stir conveyance chamber 21 via a toner-replenishment port (not illustrated) from the toner container 4*a*.

The toner supply roller 30 includes a non-magnetic rotation sleeve and a fixed magnet body. The non-magnetic rotation sleeve rotates in the anticlockwise direction in FIG. 2. The fixed magnet body has a plurality of magnetic poles internally included in the rotation sleeve.

The developing roller 31 includes a cylindrically-shaped development sleeve and a developing-roller-side-magnetic pole. The development sleeve rotates in the anticlockwise direction in FIG. 2. The developing-roller-side-magnetic pole is secured into the development sleeve. The toner supply roller 30 and the developing roller 31 are opposed to one another at their facing positions (opposing positions) at a predetermined clearance. The developing-roller-side-magnetic pole has a polarity different from a magnetic pole (main pole) opposed to the fixed magnet body.

In the developing container 20, a trimming blade (which is also referred to as regulating blade) 33 is mounted along a longitudinal direction (the direction orthogonal to the paper surface of FIG. 2) of the toner supply roller 30. The trimming blade 33 is located at an upstream side with respect to the opposing position of the developing roller 31 and the toner supply roller 30 in a rotation direction (the anticlockwise direction in FIG. 2) of the toner supply roller 30. Then, a slight gap is formed between a distal end portion of the trimming blade 33 and a surface of the toner supply roller 30.

A DC voltage (hereinafter referred to as $V_{s/v}$ (DC)) and an AC voltage (hereinafter referred to as $V_{s/v}$ (AC)) are applied to the developing roller 31. A DC voltage (hereinafter referred to as $V_{mag}$ (DC)) and an AC voltage (hereinafter referred to as $V_{mag}$ (AC)) are applied to the toner supply roller 30. These DC voltages and AC voltages are applied to the developing roller 31 and the toner supply roller 30 via a bias control circuit from a developing bias power source (each of components is not illustrated).

As described above, the developer is circulated in the stir conveyance chamber 21 and the supply conveyance chamber 22, which are in the developing container 20, while being stirred by the stir conveyance screw 25*a* and the supply conveyance screw 25*b*. Then, the toners in the developer are charged, and the developer is conveyed to the toner supply roller 30 by the supply conveyance screw 25*b*. Then, a magnetic brush (not illustrated) is formed on the toner supply roller 30. The trimming blade 33 regulates a layer thickness of the magnetic brush on the toner supply roller 30. After that, the magnetic brush is conveyed to an opposing portion of the toner supply roller 30 and the developing roller 31. Then, an electric potential difference $\Delta V$ between $V_{mag}$ (DC) applied to the toner supply roller 30 and $V_{s/v}$ (DC) applied to the developing roller 31, and a magnetic field form a thin toner layer on the developing roller 31.

The rotation of the developing roller 31 conveys the thin toner layer formed on the developing roller 31 by a contact with the magnetic brush on the toner supply roller 30 to the opposing portion (an opposing region) of the photoreceptor drum 1*a* and the developing roller 31. $V_{s/v}$ (DC) and $V_{s/v}$ (AC) are applied to the developing roller 31, and thus an electric potential difference between the photoreceptor drum 1*a* flies the toner to develop an electrostatic latent image on the photoreceptor drum 1*a*.

The toner, which has not been used in the development, is conveyed to the opposing portion of the developing roller 31 and the toner supply roller 30 again, and then is recovered by the magnetic brush on the toner supply roller 30. Then, the magnetic brush is dropped into the supply conveyance chamber 22 after being removed from the toner supply roller 30 at an identical pole portion of the fixed magnet body.

After that, a toner in a predetermined amount is replenished on the basis of a detection result of the toner density sensor 28 from a toner replenishment port (not illustrated), so as to generate the two-component developer, which is uniformly charged at an appropriate toner density again, while circulating in the supply conveyance chamber 22 and the stir conveyance chamber 21. This developer is supplied onto the toner supply roller 30 by the supply conveyance screw 25*b* again to form the magnetic brush, so as to be conveyed to the trimming blade 33.

A toner-reception supporting member 35, which projects inside the developing container 20 and has a triangular-shaped cross section, is located in the proximity of the developing roller 31, on a right side wall of the developing container 20 in FIG. 2. As illustrated in FIG. 2, the toner-reception supporting member 35 is arranged along the longitudinal direction (the direction perpendicular to the paper surface in FIG. 2) of the developing container 20. The top surface of the toner-reception supporting member 35 is opposed to the toner supply roller 30 and the developing roller 31 and constitutes a wall portion inclining downward toward the toner supply roller 30 direction from the developing roller 31. On the top surface of the toner-reception supporting member 35, a toner reception member 37 that receives the toner removed from the developing roller 31 to drop is mounted along the longitudinal direction.

Figure 3:
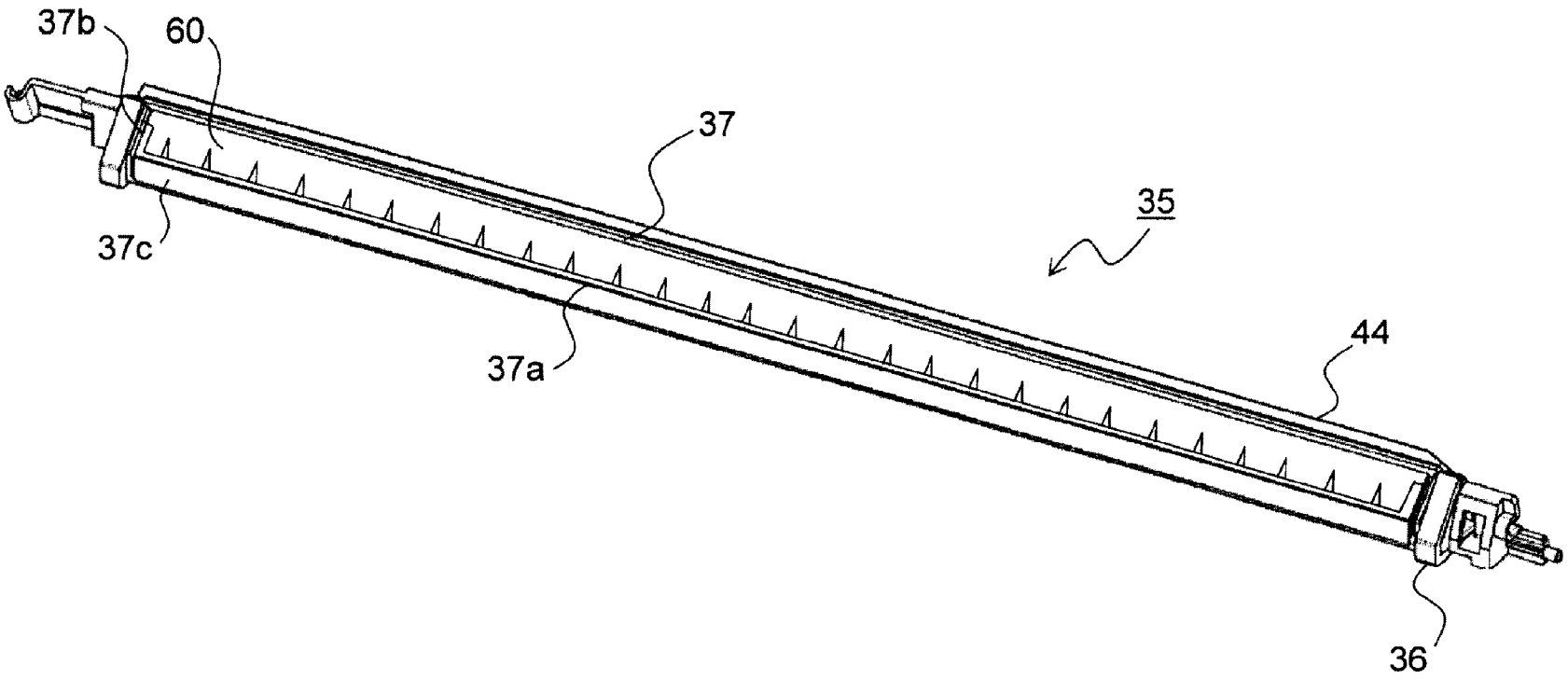
FIG. 3 illustrates a perspective view where a toner-reception supporting member used in the developing device according to the first embodiment is viewed from an inside of a developing container.

FIG. 3 illustrates a perspective view illustrating the toner-reception supporting member 35, which is used in the developing devices 3*a* to 3*d* according to the first embodiment, viewed from the inside of the developing container 20

Figure 4:
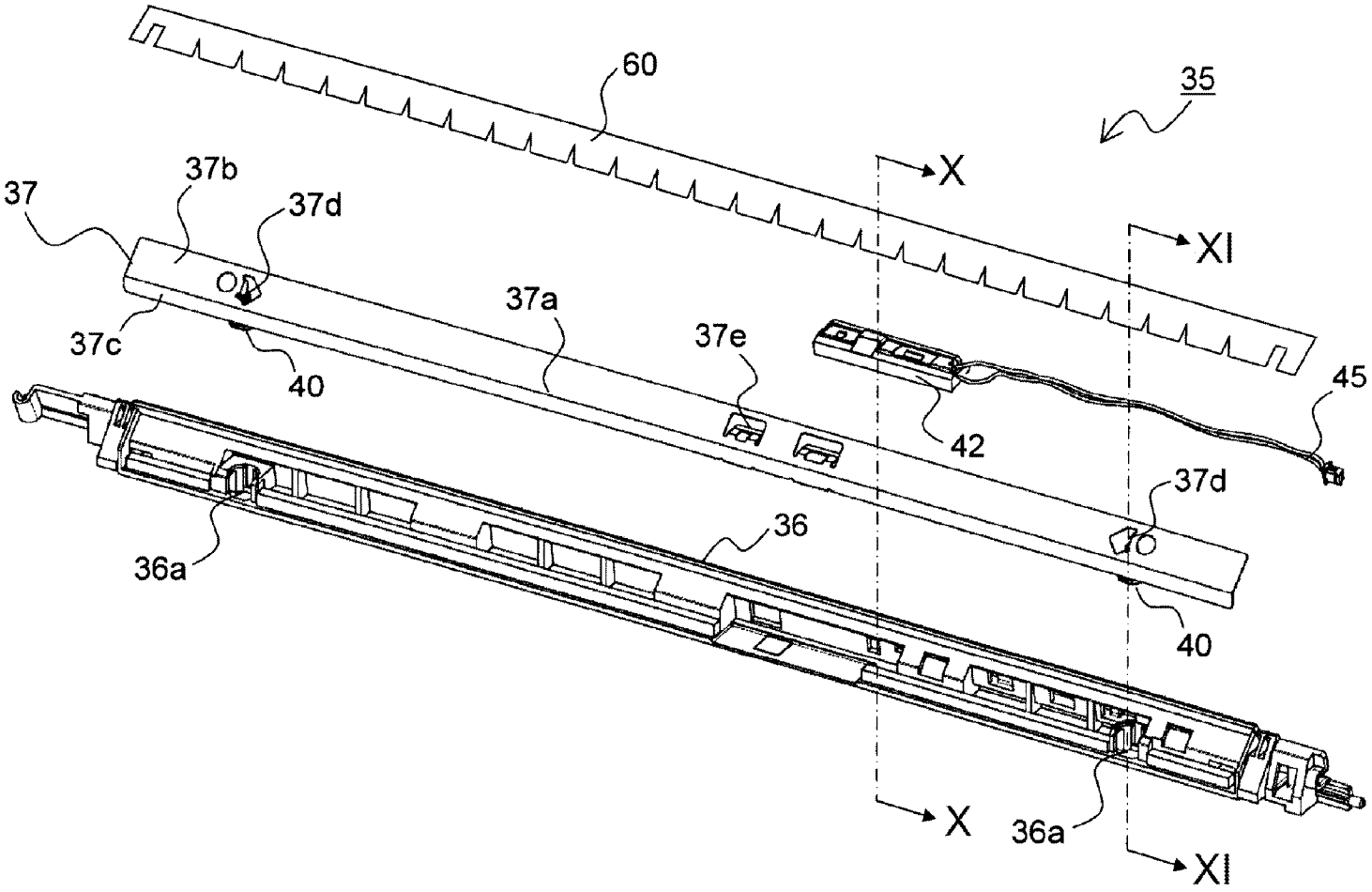
FIG. 4 illustrates an exploded perspective view illustrating the toner-reception supporting member used in the developing device according to the first embodiment.

(the left side in FIG. 2). FIG. 4 illustrates an exploded perspective view of the toner-reception supporting member 35.

The toner reception member 37, which is made of a sheet metal, has a bent shape with a bending portion 37*a* formed along the longitudinal direction and is partitioned into a toner receiving surface 37*b* opposed to the developing roller 31 across the bending portion 37*a* (see FIG. 2) and an approximately perpendicular toner-dropping surface 37*c* opposed to the toner supply roller 30. The toner reception member 37 is supported by a supporting-member main body 36, which is made of resin, via two coil springs 40. Specifically, an engaging portion 37*d* with which one end of the coil spring 40 engages is bent and formed at two positions of both the end portions of the toner reception member 37, and a spring pedestal 39 (see FIG. 11) is mounted to the other end of the coil spring 40. The spring pedestal 39 is held by a spring-pedestal holding portion 36*a* of the supporting-member main body 36. In an approximately center portion of the toner reception member 37, a holder holding portion 37*e* that supports a vibration generating unit 42 is bent and formed.

Inside the vibration generating unit 42, a vibration motor 43, and circuits and electronic components (not illustrated) for controlling driving of the vibration motor 43 are implemented, and a lead wire 45 for supplying electric power to the vibration motor 43 is connected.

Sheet members 41*a* and 41*b* (see FIG. 10) are stuck on a surface of the toner reception member 37. The sheet members 41*a* and 41*b* are formed of a material to which the toner is harder to attach than the toner reception member 37 so as to reduce toner attachment to the toner reception member 37. The material for the sheet members 41*a* and 41*b* includes, for example, a fluororesin sheet.

The sheet member 41*a* is stuck so as to cover the surface (the toner-dropping surface 37*c*) of the toner reception member 37 including a boundary of the supporting-member main body 36 at the trimming blade 33 side and the toner reception member 37. The sheet member 41*b* is stuck so as to cover the whole region of the toner receiving surface 37*b* including a boundary of the supporting-member main body 36 at a sealing member 44 side and the toner reception member 37, the engaging portion 37*d*, and the holder holding portion 37*e*. The sheet members 41*a* and 41*b* reduce the attachment of the toner to the toner receiving surface 37*b* and the toner-dropping surface 37*c* and also prevent intrusion of the toner to the inside of the toner-reception supporting member 35 from the boundary of the supporting-member main body 36 and the toner reception member 37 and prevent an operation failure of the vibration motor 43 caused by the intrusion of the toner.

The film-shaped sealing member 44 is located on an upper end of the supporting-member main body 36. The sealing member 44 has a distal end portion that extends in the longitudinal direction (lateral direction in FIG. 3) of the supporting-member main body 36 so as to contact with the surface of the photoreceptor drum 1*a*, and has a function of shielding the toner inside the developing container 20 (see FIG. 2) so as not to leak outside.

Furthermore, the toner reception member 37 supports a sheet-shaped toner crushing member 60 that overlaps approximately the whole region of the toner receiving surface 37*b* in the longitudinal direction. As a material of the toner crushing member 60, it is only necessary that the material has a certain degree of rigidity, and here a sheet made of polyethylene terephthalate (PET) is employed. The detail configuration of the toner crushing member 60 will be described later.

Figure 5:
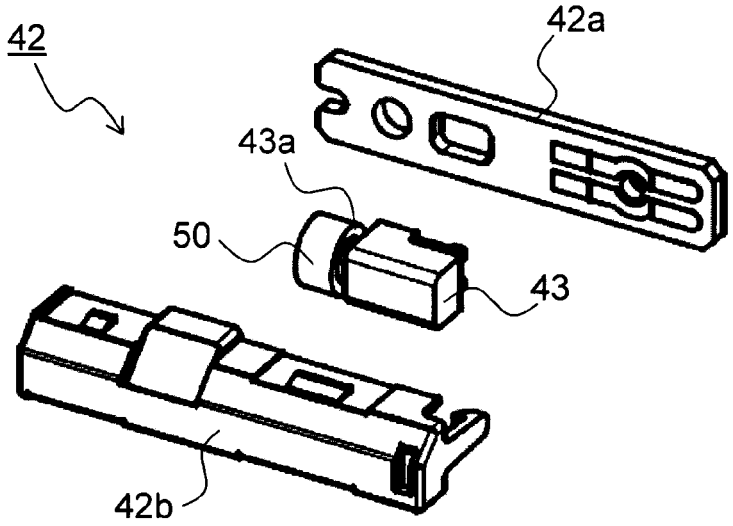
FIG. 5 illustrates an exploded perspective view illustrating a vibration generating unit.

FIG. 5 illustrates an exploded perspective view illustrating the vibration generating unit 42 in FIG. 4. The vibration generating unit 42 includes the vibration motor 43, a motor installation plate 42*a* to which the vibration motor 43 is secured, and a cover member 42*b*. A vibration weight 50 is secured to an output shaft 43*a* of the vibration motor 43. The vibration motor 43 is secured such that the output shaft 43*a* is arranged along the longitudinal direction of the toner reception member 37.

Figure 6:
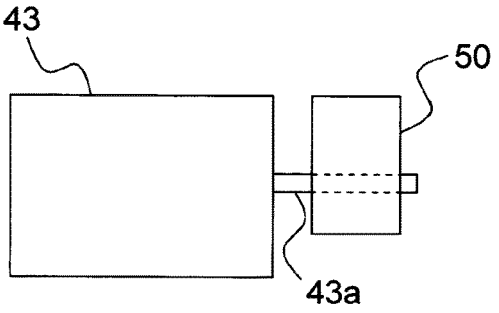
FIG. 6 illustrates a front view illustrating a vibration motor.
Figure 7:
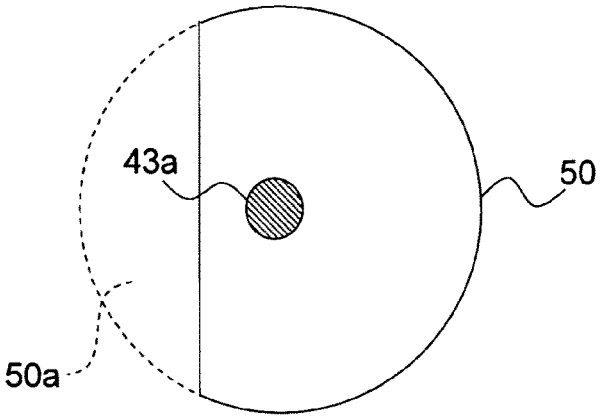
FIG. 7 illustrates a side view where the vibration motor is viewed from a vibration weight side.

FIG. 6 illustrates a front view illustrating the vibration motor 43. FIG. 7 illustrates a side view of the vibration motor 43 viewed from the vibration weight 50 side. When viewed from the output shaft 43*a* direction of the vibration motor 43 (the right direction in FIG. 6), as illustrated in FIG. 7, the vibration weight 50 has a cam shape where a cutout portion 50*a* is formed in a part of a circular plate and has a shape asymmetrical with respect to the output shaft 43*a*. Rotation of the output shaft 43*a* at equal to or more than a predetermined speed acts a centrifugal force smaller compared to other portions on the cutout portion 50*a*, and this applies a non-uniform centrifugal force to the vibration weight 50. Transmission of this centrifugal force to the output shaft 43*a* vibrates the vibration motor 43. The shape of the vibration weight 50 is not limited to a cam shape, and it can be formed in any shape that displaces the center of gravity with respect to the output shaft 43*a*.

Figure 8:
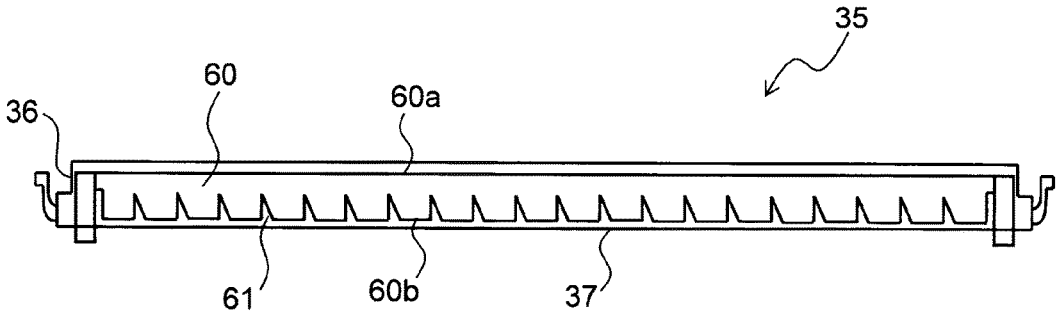
FIG. 8 illustrates a plan view illustrating the toner-reception supporting member used in the developing device according to the first embodiment.
Figure 9:
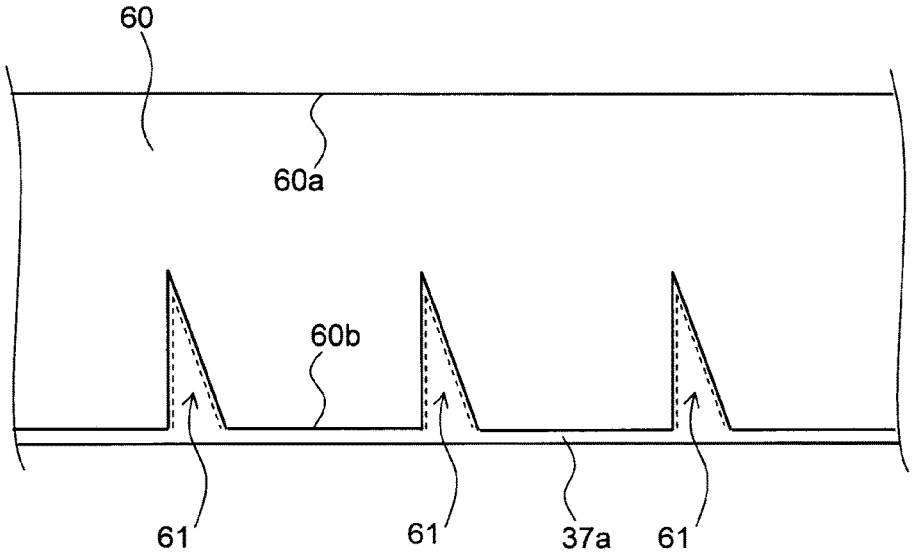
FIG. 9 illustrates an enlarged view near slits of a toner crushing member in FIG. 8.
Figure 10:
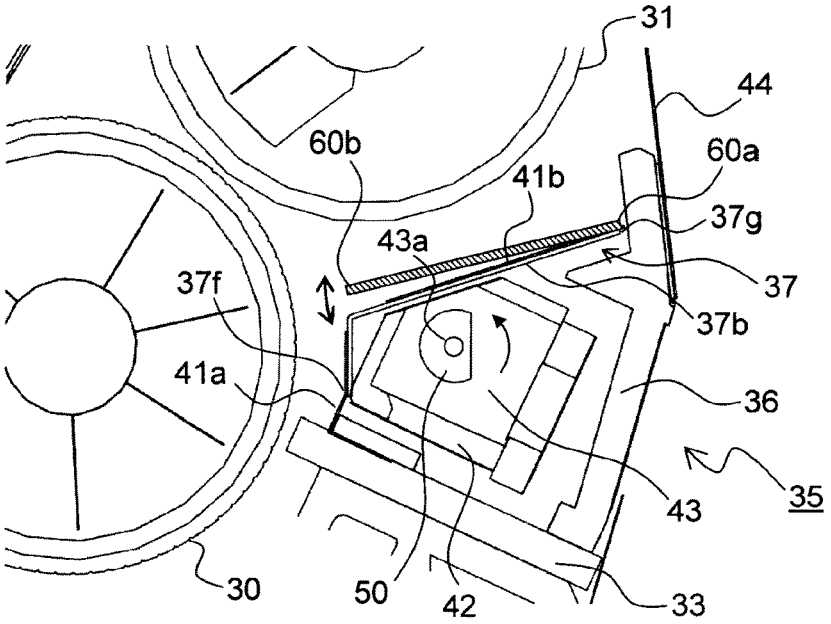
FIG. 10 is a cross-sectional side view illustrating the periphery of the toner-reception supporting member in the developing device according to the first embodiment and illustrates a cross section near the vibration motor.
Figure 11:
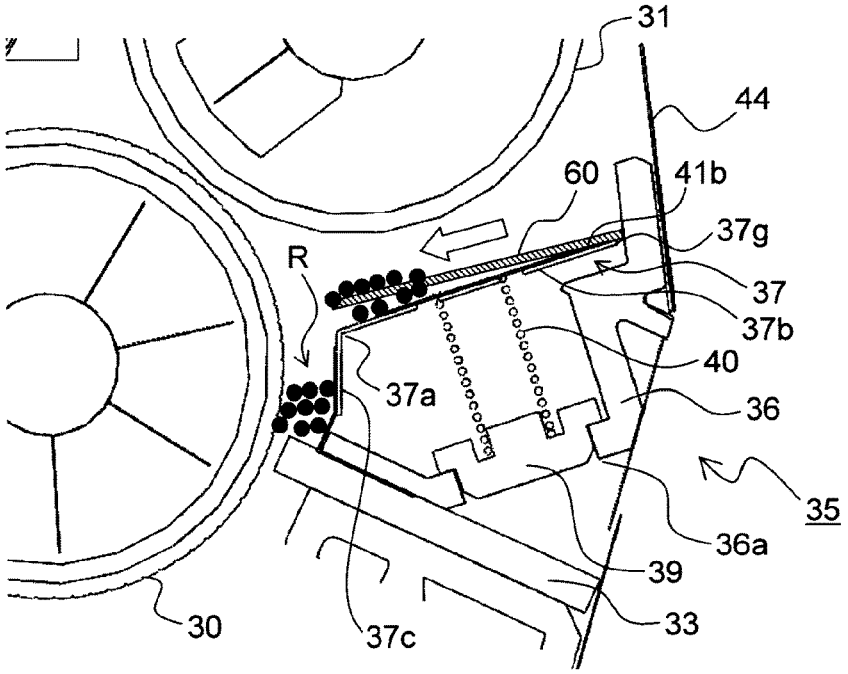
FIG. 11 is a cross-sectional side view illustrating the periphery of the toner-reception supporting member in the developing device according to the first embodiment and illustrates a cross section including a coil spring.

FIG. 8 illustrates a plan view illustrating the toner-reception supporting member 35 used in the developing device 3*a* according to the first embodiment. FIG. 9 illustrates an enlarged view near slits 61 of the toner crushing member 60 in FIG. 8. FIGS. 10 and 11 illustrate cross-sectional side views illustrating an internal configuration of the toner-reception supporting member 35 used in the developing device 3*a* according to the first embodiment. FIG. 10 illustrates a cross section (a cross section viewed from the arrow direction of the X-X line in FIG. 4) near the vibration motor 43 of the toner-reception supporting member 35. FIG. 11 illustrates a cross section (a cross section viewed from the arrow direction of the XI-XI line in FIG. 4) including the coil spring 40 of the toner-reception supporting member 35.

The toner reception member 37 is arranged such that the toner receiving surface 37*b* opposed to the developing roller 31 is inclined to make an upward slope toward the photoreceptor drum 1*a* side from the toner supply roller 30 side, and the toner-dropping surface 37*c* opposed to the toner supply roller 30 becomes approximately perpendicular.

As illustrated in FIGS. 9 and 10, the toner reception member 37 has an end edge 37*f* only at the toner supply roller 30 side in abutting contact with the supporting-member main body 36, and an end edge 37*g* at the opposite side (photoreceptor drum 1*a* side) is a free end. Then, the approximately center portion in a width direction (the lateral direction in FIG. 10) of the toner receiving surface 37*b* is supported by the supporting-member main body 36 via the vibration generating unit 42. Thus, the toner reception member 37 is configured swingably with the end edge 37*f* as a fulcrum. The vibration motor 43 is arranged such that the output shaft 43*a* becomes approximately parallel to the longitudinal direction of the toner reception member 37.

As illustrated in FIG. 8, the toner crushing member 60 is arranged so as to overlap approximately the whole region of the toner receiving surface 37*b* of the toner reception member 37. As illustrated in FIG. 10, in the toner crushing member 60, only an end edge (hereinafter referred to as a first end edge 60*a*) at the end edge 37*g* (which is also referred to as swinging end) side of the toner receiving surface 37*b* is secured to the toner receiving surface 37*b*, and an end edge (hereinafter referred to as a second end edge 60*b*) at the bending portion 37*a* side is a free end.

When an image is not formed, rotating the output shaft 43*a* of the vibration motor 43 at a high speed (for example, approximately 10,000 rpm) rotates also the vibration weight 50 at the high speed in conjunction with the output shaft 43*a*. At this time, since the non-uniform centrifugal force is applied to the vibration weight 50, the vibration generating unit 42 including the vibration motor 43 and the motor installation holder 42*a*, 42*b* vibrates via the output shaft 43*a*. Then, the toner reception member 37, to which the vibration generating unit 42 is mounted, also vibrates. Specifically, the toner receiving surface 37*b* of the toner reception member 37 vibrates with the end edge 37*f* as a fulcrum such that the amplitude becomes larger toward the end edge 37*g*. This vibration of the toner reception member 37 causes the toner accumulated at the end edge 37*g* side of the toner receiving surface 37*b* to bounce up to the end edge 37*f* side (the white arrow direction) and to move gradually to the end edge 37*f* side.

The vibration of the toner receiving surface 37*b* vibrates also the toner crushing member 60, which overlaps the toner receiving surface 37*b*. Here, in the toner crushing member 60, only the first end edge 60*a* is secured to the toner receiving surface 37*b*. Consequently, the second end edge 60*b* of the toner crushing member 60 can vibrate independently from the toner receiving surface 37*b*.

As a result, the second end edge 60*b* of the toner crushing member 60 vibrates while repeatedly contacting with or separating from the toner receiving surface 37*b*. Thus, even if the toner accumulated in the proximity of a boundary of the toner crushing member 60 and the toner receiving surface 37*b* causes blocking, the lump-shaped toner, which has caused blocking, moves to the end edge 37*f* side while being crushed by the vibration of the second end edge 60*b* of the toner crushing member 60.

In the second end edge 60*b* of the toner crushing member 60, the many wedge-shaped slits 61 heading for the first end edge 60*a* are formed. That is, the second end edge 60*b* of the toner crushing member 60 is divided into many swing pieces by the slits 61. This causes the respective swing pieces of the toner crushing member 60 to warp partially to crush the toner, which has accumulated at the boundary portion of the toner crushing member 60 and the toner receiving surface 37*b*, by its restoring force, and thus, ensures efficiently shaking off the lump-shaped toner, which has caused blocking.

The shape of the slit 61 is not specifically limited; however, for example, the slit 61 having one linear-shaped slit has a less boundary portion of the toner crushing member 60 and the toner receiving surface 37*b*, and thus has a less effect to crush the toner. Forming a shape of the slit 61 like a wedge shape that has a predetermined width at the second end edge 60*b* of the toner crushing member 60 makes the two facing sides of the slit 61 to be the boundary portion (indicated by the dashed lines in FIG. 9) of the toner crushing member 60 and the toner receiving surface 37*b*. This results in increasing the boundary portion of the toner crushing member 60 and the toner receiving surface 37*b* and ensures a significant effect to crush the lump-shaped toner. The shape of the slit 61 that has a width at the second end edge 60*b* includes a rectangular shape and a U-shape other than the wedge shape.

As illustrated in FIG. 11, the vibration of the toner receiving surface 37*b* and the toner crushing member 60 causes the toner T accumulated on the toner receiving surface 37*b* to slide down below (in the white arrow direction in FIG. 11) along an inclination of the toner receiving surface 37*b* and to drop freely into a region R sandwiched between the approximately perpendicular toner-dropping surface 37*c* and the toner supply roller 30. A part of the toner having dropped into the region R directly passes through the gap of the trimming blade 33 and the toner supply roller 30 to drop inside the supply conveyance chamber 22.

In order to return the toner, which have dropped into the region R, to the supply conveyance chamber 22, when an image is not formed, the embodiment rotates (reversely rotates) the developing roller 31 and the toner supply roller 30 in a direction (in a clockwise direction in FIG. 10) opposite to a direction during image formation. Reversely rotating the toner supply roller 30 causes the toner, which has dropped into the region R and has been accumulated on a distal end of the trimming blade 33, to be scraped off by the magnetic brush of the toner supply roller 30. Subsequently, the toner passes through the gap of the toner supply roller 30 and the trimming blade 33 while corotating with the surface of the toner supply roller 30 and then is forcibly returned to the supply conveyance chamber 22 after being removed from the toner supply roller 30 at an identical pole portion of the fixed magnet body.

In the reverse rotation of the developing roller 31 and the toner supply roller 30, adjusting a magnetic force and an arrangement of the magnetic poles (regulation poles) of the fixed magnet body opposed to the trimming blade 33 such that a point of the magnetic brush formed in the toner supply roller 30 becomes longer enhances the effect to scrape off the toner accumulated on the distal end of the trimming blade 33. The reverse rotation of the developing roller 31 and the toner supply roller 30 causes also the stir conveyance screw 25*a* and the supply conveyance screw 25*b* to rotate reversely, and thus the developer in the developing container 20 may overflow from the toner-replenishment port, or a noise of the toner print density sensor 28 may occur by occurrence of unevenness of the developer in the developing container 20. Therefore, after the developing roller 31 and the toner supply roller 30 are rotated reversely, it is preferred that the developing roller 31 and the toner supply roller 30 be rotated forward for a certain period of time.

When the toner reception member 37 is vibrated, it is also possible to rotate the toner supply roller 30 and the developing roller 31 forward. Rotating the toner supply roller 30 forward causes a part of the toner that has dropped into the region R from the toner receiving surface 37*b* to attach to the magnetic brush on the toner supply roller 30. The remaining toner that has not attached to the magnetic brush on the toner supply roller 30 passes through the gap of the toner supply roller 30 and the trimming blade 33 to drop inside the supply conveyance chamber 22.

The embodiment rotates the output shaft 43*a* of the vibration motor 43 in a direction (the anticlockwise direction in FIG. 10) where the outer peripheral surface of the output shaft 43*a* at the side opposed to the toner reception member 37 moves from the free end (end edge 37*g*) toward the fulcrum (end edge 37*f*) of the toner reception member 37. Rotating the output shaft 43*a* in this direction causes the toner reception member 37 to vibrate so as to move the toner accumulated on the toner receiving surface 37*b* to the end edge 37*f* side from the end edge 37*g* side.

On the other hand, rotating the output shaft 43*a* in the opposite direction (the clockwise direction in FIG. 10)

causes the toner to move so as to gradually rise to the end edge 37*g* side from the end edge 37*f* side by the vibration of the toner reception member 37, and thus the toner accumulated on the toner receiving surface 37*b* does not slide down. Therefore, rotating the output shaft 43*a* of the vibration motor 43 as the embodiment ensures effectively dropping the toner accumulated on the toner receiving surface 37*b* into the region R along a downward slope.

Furthermore, attachment of the sheet members 41*a* and 41*b* on the surface of the toner reception member 37 ensures the reduced attachment of the toner onto the toner reception member 37. The sheet members 41*a* and 41*b* are attached so as to cover the boundary of the supporting-member main body 36 and the toner reception member 37, the engaging portion 37*d*, and the holder holding portion 37*e*. Consequently, this ensures preventing intrusion of the toner inside the toner-reception supporting member 35 from the boundary of the supporting-member main body 36 and the toner reception member 37 and preventing an operation failure of the vibration motor 43 caused by the intrusion of the toner.

The vibration of the toner reception member 37 may be performed at every time when a printing operation is terminated or may be performed at a predetermined timing such as when the number of printed sheets reaches a predetermined number of sheets or when a temperature inside the developing device 3*a* becomes equal to or more than a predetermined value. The timing of vibrating the toner reception member 37 and the timing of reversely rotating (or forwardly rotating) the developing roller 31 and the toner supply roller 30 may be identical or may be different. Vibrating the toner reception member 37 at every time when a predetermined number of printed sheets is reached automatically performs the vibration of the toner reception member 37 corresponding to the number of printed sheets. Consequently, this eliminates the need for a user itself to set the vibration of the toner reception member 37 manually and ensures avoidance of a setting error, a forgotten setting, or performing of unnecessary vibration.

Figure 12:
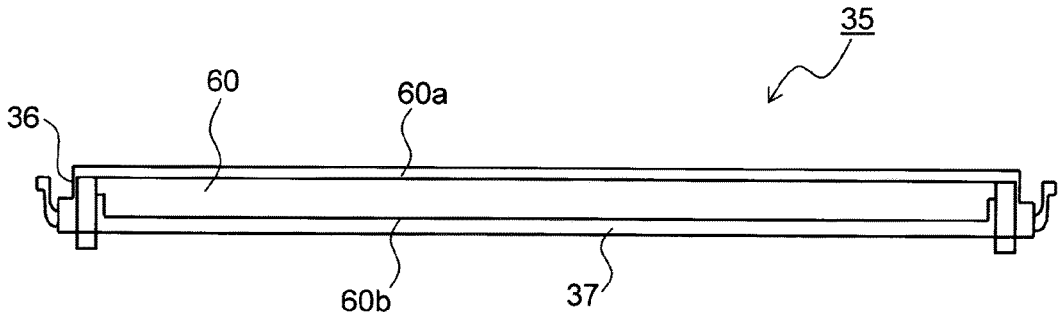
FIG. 12 illustrates a plan view illustrating a toner-reception supporting member used for a developing device according to a second embodiment of the disclosure.
Figure 13:
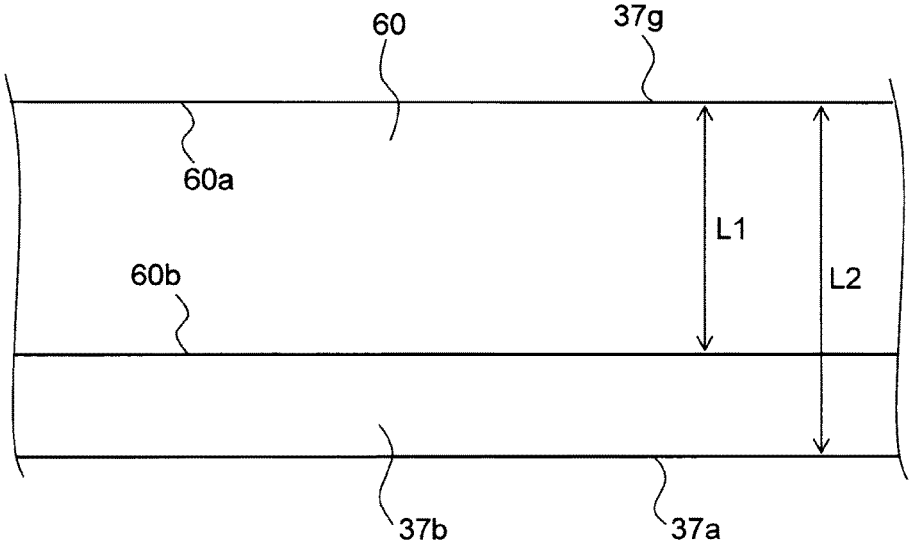
FIG. 13 illustrates an enlarged view illustrating a boundary portion of a toner receiving surface and a toner crushing member in FIG. 12.
Figure 14:
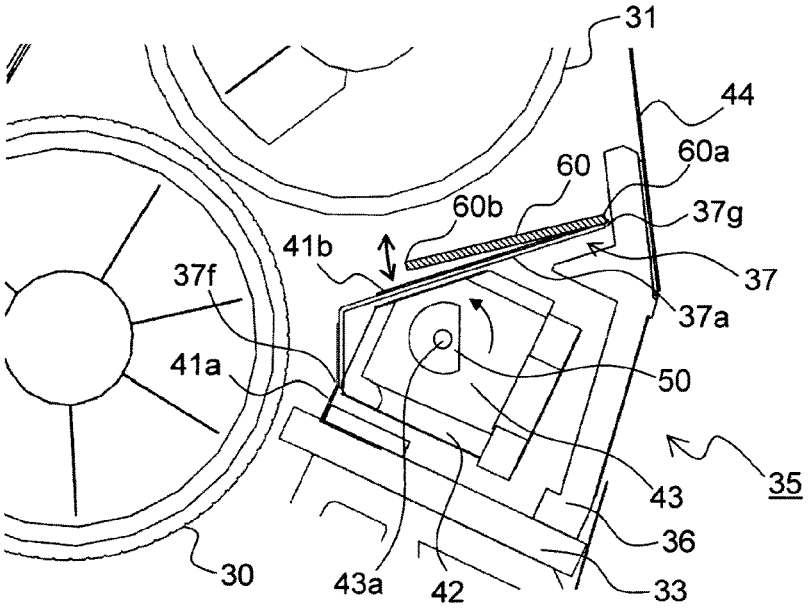
FIG. 14 is a cross-sectional side view illustrating the periphery of the toner-reception supporting member in the developing device according to the second embodiment and illustrates a cross section near a vibration motor.
Figure 15:
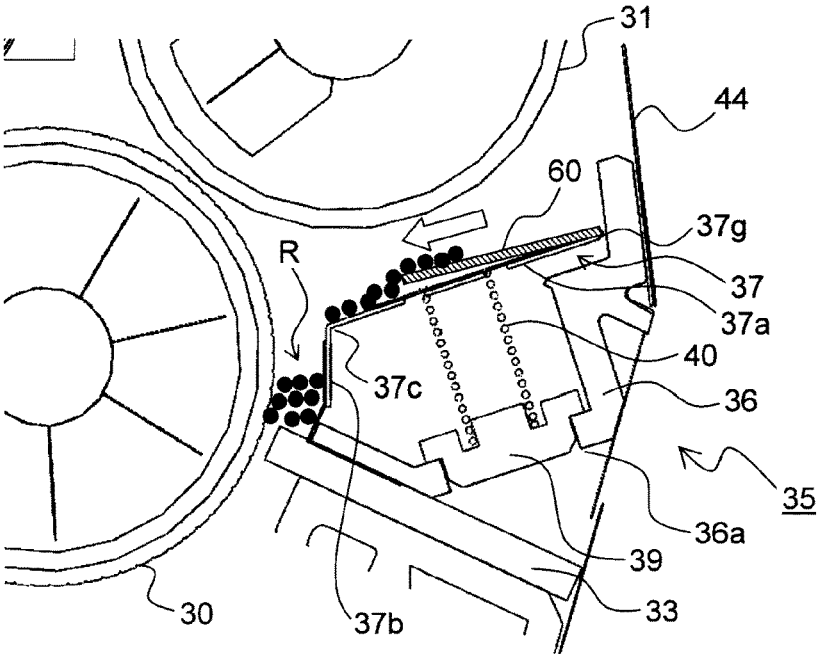
FIG. 15 is a cross-sectional side view illustrating the periphery of the toner-reception supporting member in the developing device according to the second embodiment and illustrates a cross section including a coil spring.

FIG. 12 illustrates a plan view illustrating the toner-reception supporting member 35 used in the developing device 3*a* according to a second embodiment of the disclosure. FIG. 13 illustrates an enlarged view illustrating the boundary portion of the toner receiving surface 37*b* and the toner crushing member 60 in FIG. 12. FIGS. 14 and 15 illustrate cross-sectional side views illustrating the periphery of the toner-reception supporting member 35 in the developing device 3*a* according to the second embodiment. FIG. 14 illustrates a cross section near the vibration motor 43, and FIG. 15 illustrates a cross section including the coil spring 40. Here, the developing device 3*a* will be described and the description about the developing devices 3*b* to 3*d* will be omitted because of a similar configuration.

In the embodiment, the slit 61 is not formed in the second end edge 60*b* of the toner crushing member 60. A width (a length from the first end edge 60*a* to the second end edge 60*b*) L1 in a direction orthogonal to the longitudinal direction of the toner crushing member 60 is formed shorter than a width (a length from the bending portion 37*a* to the end edge 37*g*) L2 in a direction orthogonal to the longitudinal direction of the toner receiving surface 37*b*. The configuration of the other portions of the toner-reception supporting member 35 is similar to the first embodiment.

Also in this embodiment, since the second end edge 60*b* of the toner crushing member 60 vibrates while repeatedly performing contact and separation from the toner receiving surface 37*b*, even if the toner accumulated near the boundary of the toner crushing member 60 and the toner receiving surface 37*b* causes blocking, the lump-shaped toner, which has caused blocking, moves to the end edge 37*f* side while being crushed by the vibration of the second end edge 60*b* of the toner crushing member 60. This ensures efficiently shaking off the lump-shaped toner, which is accumulated and has caused blocking on the toner receiving surface 37*b*.

The disclosure is not limited to the above-described respective embodiments and can be variously modified without departing from the spirit of the disclosure. For example, the shapes and the configurations of the toner-reception supporting member 35 and the toner reception member 37, which are described in the above-described respective embodiments, are examples and are not particularly limited to the above-described respective embodiments, and these are appropriately determined corresponding to, for example, a device configuration.

For example, while the above-described respective embodiments employ the configuration that secures the first end edge 60*a* of the toner crushing member 60 to the end edge 37*g* of the toner receiving surface 37*b* at the photoreceptor drum 1*a* side and swings the second end edge 60*b* of the toner crushing member 60 relative to the toner receiving surface 37*b*, both the end portions of the toner crushing member 60 in the longitudinal direction (the lateral direction in FIGS. 8 and 12) may be secured to the toner receiving surface 37*b*. In this case, since both the first end edge 60*a* and the second end edge 60*b* of the toner crushing member 60 are not secured to the toner receiving surface 37*b*, the amplitude of the toner crushing member 60 becomes larger; however, durability of the toner crushing member 60 decreases because of a small fixed region of the toner crushing member 60 with respect to the toner receiving surface 37*b*. Further, the toner may also enter the gap of the toner receiving surface 37*b* and the toner crushing member 60 from the first end edge 60*a* side. Therefore, as the first and second embodiments, it is preferred to employ the configuration that secures the first end edge 60*a* of the toner crushing member 60 to the end edge 37*g* of the toner receiving surface 37*b* at the photoreceptor drum 1*a* side.

Figure 16:
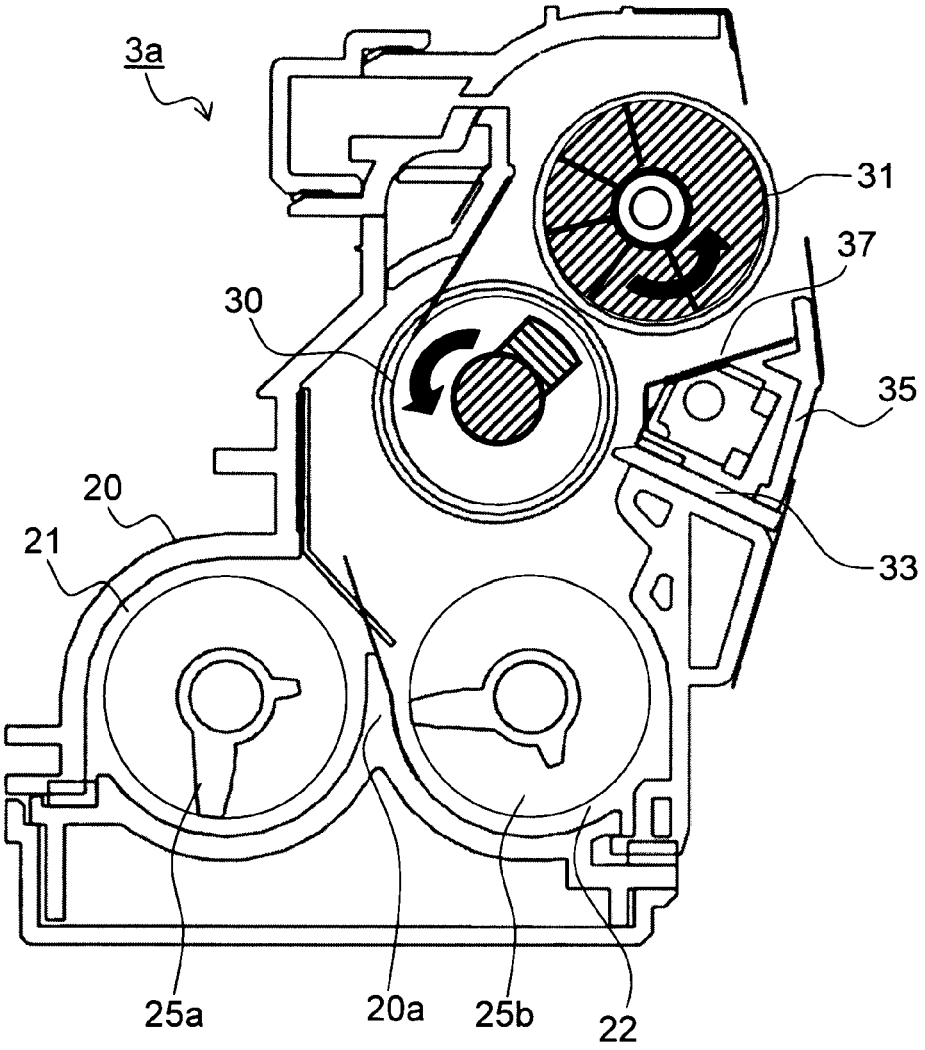
FIG. 16 illustrates a cross-sectional side view illustrating a developing device of the disclosure where a toner supply roller and a developing roller are reversely arranged.

While in the above-described respective embodiments the disclosure is applied to the developing devices 3*a* to 3*d*, which use the two-component developer, form the magnetic brush on the toner supply roller 30, move only the toner to the developing roller 31 from the toner supply roller 30, and then supply the toner to the photoreceptor drums 1*a* to 1*d* from the developing roller 31, in addition, as illustrated in FIG. 16, the disclosure is also applicable to a developing device where the developing roller 31 and the toner supply roller 30 are positioned reversely to the above-described respective embodiments. In this developing device, the magnetic brush made of the two-component developer that is held on a surface of the developing roller 31 (that is a magnetic roller having the configuration similar to the toner supply roller 30 of the above-described respective embodiments in the configuration) supplies the toner to the photoreceptor drums 1*a* to 1*d*. Then, the toner held on the surface of the toner supply roller 30 (that has the configuration similar to the developing roller 31 of the above-described respective embodiments in the configuration) is supplied to the developing roller 31, and a surplus toner, which is on the surface of the developing roller 31, is recovered using the toner supply roller 30. Even this configuration ensures the effective reduction of the toner, which is dropped from the developing roller 31, being accumulated on the periphery of the regulating blade 33, which is opposed to the toner supply roller 30.

The toner accumulated on a toner reception member may include a lot of toner externally added agents, and a charging capability is degraded by deterioration; thus, fluidity becomes poor. In particular, in the case of toner having low heat resistance, accumulated toner is likely to harden by temperature rise in the periphery of a developing device. A usage environment of an image forming apparatus, an amount of toner consumption in a developing device or similar condition also varies the fluidity of toner.

With the disclosure, a toner crushing member that swings with respect to a toner receiving surface crushes lump-shaped toner accumulated in the proximity of a boundary of the toner crushing member and the toner receiving surface. Therefore, this ensures efficiently shaking off the toner accumulated on the toner reception member and effectively reducing occurrence of an image failure caused by toner drop even when toner having low heat resistance is used, or a usage environment of an image forming apparatus, an amount of toner consumption in a developing device or similar condition degrades fluidity of toner.

The disclosure is applicable to an image forming apparatus that includes a developing device including a toner reception member opposed to a developing roller between an opposing region of an image carrier and a developing roller, and a regulating blade. Application of the disclosure ensures providing a developing device that enables efficient recovery of deteriorated toner accumulated on a toner reception member.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A developing device for supplying a toner to an image carrier on which an electrostatic latent image is formed, the developing device comprising:

a developing roller located opposed to the image carrier, the developing roller supplying the toner to the image carrier in a region opposed to the image carrier;

a toner supply roller located opposed to the developing roller, the toner supply roller supplying the toner to the developing roller in a region opposed to the developing roller;

a regulating blade located opposed to the toner supply roller at a predetermined interval;

a casing that houses the developing roller, the toner supply roller, and the regulating blade;

a toner-reception supporting member located in the casing, the toner-reception supporting member being opposed to the developing roller or the toner supply roller between the regulating blade and the image carrier;

a toner reception member located so as to make a downward slope toward the toner supply roller side from the image carrier side along a longitudinal direction of the toner-reception supporting member, the toner reception member having a toner receiving surface that receives the toner dropping from the developing roller; and a vibration generating unit that vibrates the toner reception member; wherein the toner reception member includes a sheet-shaped toner crushing member attached to overlap approximately a whole region of the toner receiving surface in a longitudinal direction, the toner crushing member is swingably supported with respect to the toner receiving surface, the toner crushing member has a first end edge at the image carrier side secured to an end edge at the image carrier side of the toner receiving surface, and a second end edge at the toner supply roller side, and the second end edge swings with respect to the toner receiving surface with the first end edge as a fulcrum, and during driving of the vibration generating unit, the developing roller and the toner supply roller are rotated in a direction opposite to a direction during image formation.

2. The developing device according to claim 1, wherein the second end edge of the toner crushing member extends up to an end edge at the toner supply roller side of the toner receiving surface, and the toner crushing member has a plurality of slits formed toward the first end edge from the second end edge.

3. The developing device according to claim 2, wherein the slits have a predetermined width at the second end edge.

4. The developing device according to claim 1, wherein the toner crushing member has a length from the first end edge to the second end edge, the length being shorter than a length from the end edge at the image carrier side of the toner receiving surface to the end edge at the toner supply roller side.

5. The developing device according to claim 1, wherein the vibration generating unit includes a vibration motor secured to a back surface of the toner reception member and a vibration weight secured such that a center of gravity is deviated relative to an output shaft of the vibration motor.

6. The developing device according to claim 5, wherein:

the vibration motor is secured to the back surface of the toner reception member such that the output shaft becomes approximately parallel to the longitudinal direction of the toner reception member;

the toner reception member is swingably supported with the end edge at the toner supply roller side as a fulcrum and the end edge at the image carrier side as a free end; and the output shaft is rotated in a direction where an outer peripheral surface of the output shaft of the vibration motor at a side opposed to the toner reception member moves from the free end side toward the fulcrum side of the toner reception member.

7. The developing device according to claim 1, wherein the developing roller and the toner supply roller are continuously rotated in a direction identical to a direction during image formation for a certain period of time after the driving of the vibration generating unit is terminated.

8. An image forming apparatus comprising the developing device according to claim 1.

* * * * *